US005556213A

United States Patent [19]

Kudo et al.

[11] Patent Number: 5,556,213

[45] Date of Patent: Sep. 17, 1996

[54] TAPE PRINTER HAVING A HALF-CUT MECHANISM

[75] Inventors: Yasunori Kudo; Manabu Shibata; Takahisa Misawa, all of Tokyo, Japan

[73] Assignee: Max Co., Ltd., Japan

[21] Appl. No.: 219,904

[22] Filed: Mar. 30, 1994

[30] Foreign Application Priority Data

Mar. 30, 1993 [JP] Japan ..... 5-097127

[51] Int. Cl.[6] ..... D41J 11/70

[52] U.S. Cl. ..... 400/621; 83/51; 156/268

[58] Field of Search ..... 400/621, 621.2; 83/51, 383, 386, 387, 861, 862, 865; 156/268, 270, 510; 101/224, 226, 227

[56] References Cited

U.S. PATENT DOCUMENTS

| | | | |
|---|---|---|---|
| 3,133,495 | 5/1964 | De Man | 400/621 |
| 3,155,215 | 11/1964 | Avery | 400/621 |
| 3,414,102 | 12/1968 | Norvelle | 400/621 X |
| 4,732,068 | 3/1988 | Yasuda | 83/575 |
| 5,066,152 | 11/1991 | Kuzuya et al. | 400/621 |
| 5,271,789 | 12/1993 | Takagi et al. | 400/621 X |

FOREIGN PATENT DOCUMENTS

| | | |
|---|---|---|
| 3445744 | 12/1984 | Germany . |
| 422654 | 1/1992 | Japan . |

OTHER PUBLICATIONS

Patent Abstracts of Japan, M–1079, Feb. 7, 1991, vol. 15/No. 53.

*Primary Examiner*—Christopher A. Bennett

*Attorney, Agent, or Firm*—Cushman Darby & Cushman, LLP

[57] ABSTRACT

A tape printer including: a printer head for printing characters, figures, etc. on a laminated tape which is formed by laminating a printing tape and a separate paper a tape releasing section for feeding the laminated tape from the tape printer and a cutter for cutting the laminated tape. A half-cut mechanism for cutting only the printing tape of the laminated tape is provided on the tape out-going side of the cutter.

6 Claims, 4 Drawing Sheets

TAPE PRINTER HAVING A HALF-CUT MECHANISM

BACKGROUND OF THE INVENTION

This invention relates to a tape printer which prints characters, figures, etc. on a laminated tape formed by laminating a printing tape and a separate paper.

In general, a tape printer of this type uses a laminated tape which is formed by sticking a printing tape on a separate paper. After characters, figures, etc. are printed on the laminated tape, the separate paper is peeled off, and the printing tape bearing the characters, figures, etc. is stuck on any desired object. For example, such tapes are often used to label items.

Peeling the separate paper from the tape is carried out by having the operator set his/her fingernail between the printing tape and the separate paper. Therefore, it is necessary for the operator to have the knack or technique of peeling the separate paper from the printing paper. At first, it is rather difficult for the operator to peel the separate paper from the printing paper.

SUMMARY OF THE INVENTION

Accordingly, an object of this invention is to eliminate the above-described difficulty accompanying a conventional tape printer.

More specifically, an object of the invention is to provide a tape printer for printing characters, figures, etc. on a laminated tape formed by laminating a printing tape and a separate paper which comprises a mechanism for cutting only the printing paper off the end portion of the laminated tape, thereby allowing the tape to be readily peeled from the separate paper. Such a mechanism should be high in durability and easily automated.

The foregoing object and other objects of the invention have been achieved by the provision of a tape printer comprising: a printer head for printing characters, figures, etc. on a laminated tape which is formed by laminating a printing tape and a separate paper; a tape releasing section for moving the laminated tape out of the tape printer; and a cutter for cutting the laminated tape, which, according to the invention, further comprises: a half-cut mechanism for cutting only the printing tape of the laminated tape, the half-cut mechanism being provided on the tape outgoing side of the cutter.

In the tape printer, preferably the half-cut mechanism comprises: a tape receiving stand for receiving the laminated tape; and a cutter for cutting the laminated tape on the tape receiving stand. The cutter includes: a pair of guide legs which abut against the tape receiving stand during cutting; and a cutting edge formed between the pair of guide legs, with the distance between the cutting edge and the guide legs being smaller than the thickness of the separate paper.

Furthermore, in the tape printer, preferably the cutter is made up of a base plate having the pair of guide legs, and a cutting edge member fixedly secured to the base plate.

The nature, utility and principle of the invention will be more clearly understood from the following detailed description and the appended claims when read in conjunction with the accompanying drawings.

DETAILED DESCRIPTION OF THE INVENTION

Figure 1:
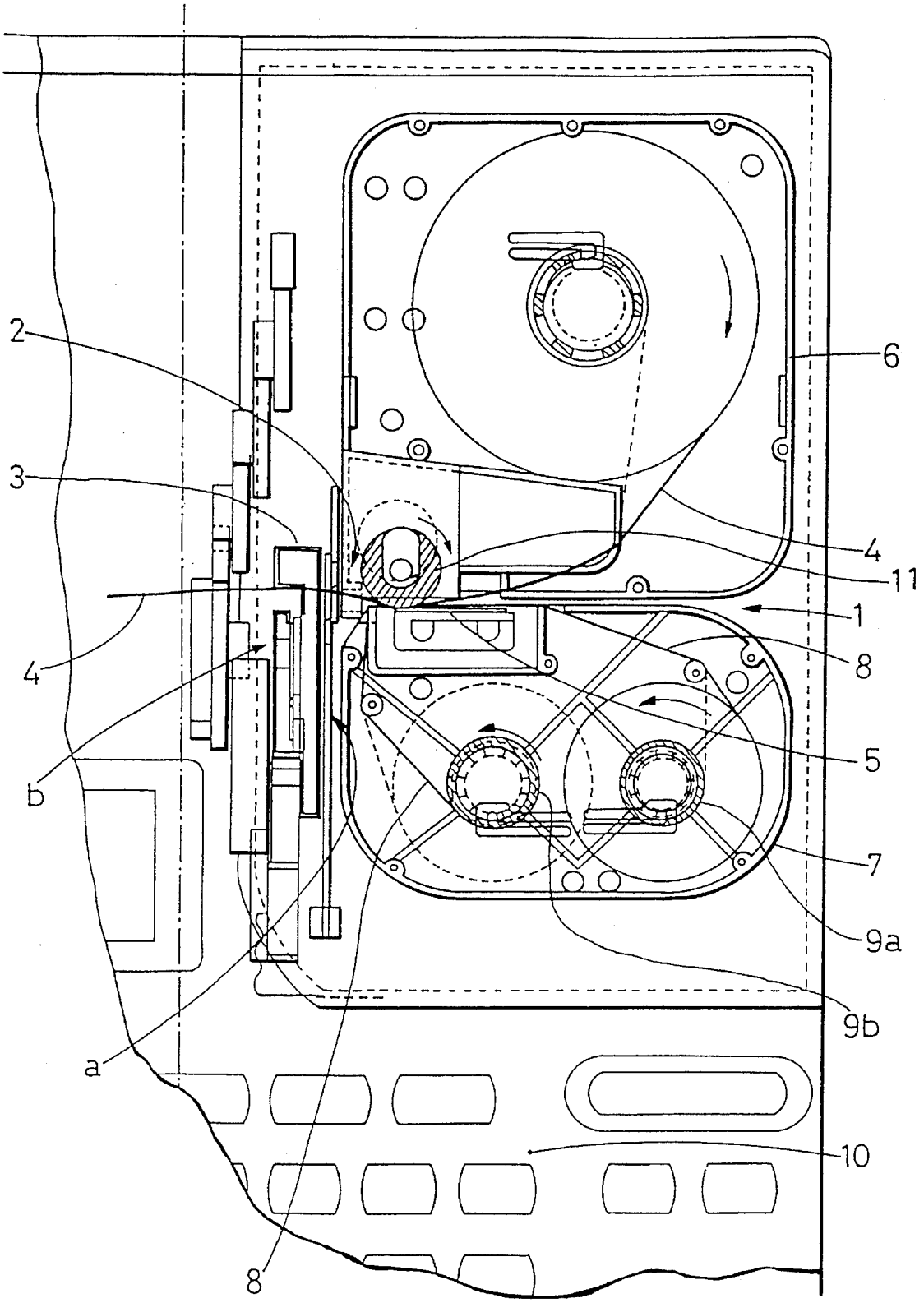
FIG. 1 is a plan view showing essential components of a tape printer according to this invention.

A tape printer according to this invention, as shown in FIG. 1, comprises: a printing section 1, a tape releasing section 2, and a cutting section 3. In the tape printer, a laminated tape 4 is run out of the tape printer body while characters, figures, etc. are being printed on it, and it is cut at the tape releasing section 2.

Figure 6:
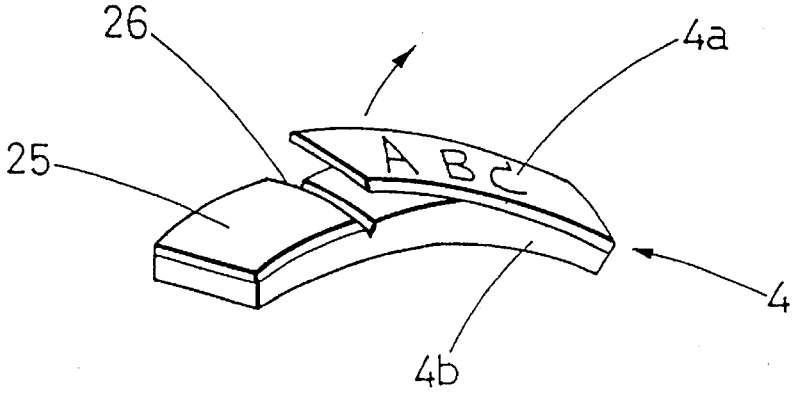
FIG. 6 is a perspective view illustrating a method of peeling a printing tape off a separate paper.

The laminated tape 4 is shown in FIG. 6 in detail. That is, it is formed by laying a separate paper 4*b* on a printing tape 4*a*.

Referring back to FIG. 1, in the printing section 1, a printer head 5 is provided, and a mounting section for a tape cassette 6 adapted to supply the laminated tape 4 is provided on one side of the printer head 5, and a mounting section for a ribbon cassette 7 adapted to supply an ink ribbon 8 is provided on the other side. The laminated tape 4 supplied from the tape cassette 6 and the ink ribbon 8 supplied from the ribbon cassette 7 are laid over the printer head 5. At the printer head 5, the ink of the ink ribbon 8 is molten to print characters, figures, etc. on the printing surface of the laminated tape 4. The ink ribbon 7*a* is supplied from a ribbon supplying reel 9*a* in the ribbon cassette 7 and then wound on a ribbon winding reel 9*b*. On the other hand, the laminated tape 4 is run out of the tape releasing section 2 provided in the printing section 1.

The printing section 1 has a drive mechanism which, in response to the operation of a keyboard 10, controls the printer head 5, and rotates a platen 11 which also serves as a roller, to move forward the laminated tape 4 and the ink ribbon 8. The drive mechanism is a conventional one.

The cutting section 3 is provided outside the tape releasing section 2. The cutting section 3 comprises a mechanism a for fully cutting the laminated tape (hereinafter referred to as "a full-cut mechanism a", when applicable), and a mechanism b for cutting the laminated tape halfway (hereinafter referred to as "a half-cut mechanism b", when applicable).

Figure 2:
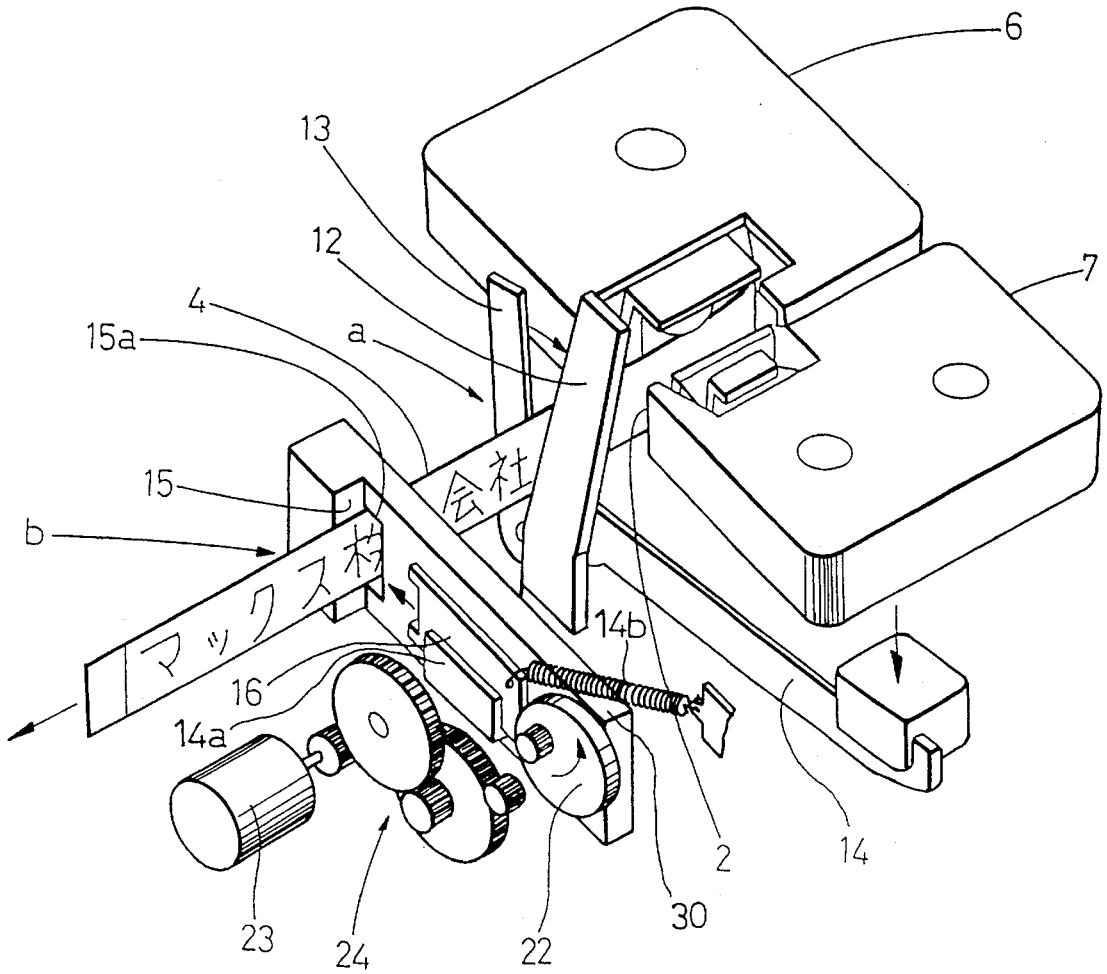
FIG. 2 is a perspective view showing a printing section and a cutting section in the tape printer according to the invention.

The full-cut mechanism a, as shown in FIG. 2, comprises: a stationary edge 12; and a movable edge 13 which is swingably mounted. An operating lever 14 extends from the base portion of the movable edge 13 in such a manner that the lever 14 is substantially perpendicular to the edge 13. The full-cut mechanism a operates as follows: The laminated tape 4 fed out of the tape printer body is laid between the stationary edge 12 and the movable edge 13. Under this condition, the end of the operating lever 14 is pushed with the finger, to fully cut the laminated tape 4. In this operation, the movable edge 13 is slid on the stationary edge 12; that is, those edges 13 and 12 operate as a pair of scissors, to fully cut the laminated tape 4. In this connection, the tape printer may be so modified that the movable edge 13 is automatically driven.

Figure 3:
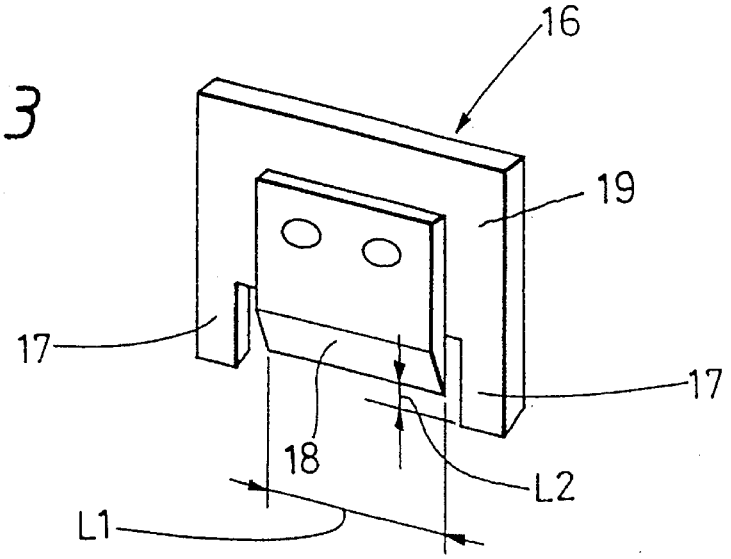
FIG. 3 is a perspective view of a cutter in a half-cut mechanism in the tape printer of the invention.
Figure 4A:
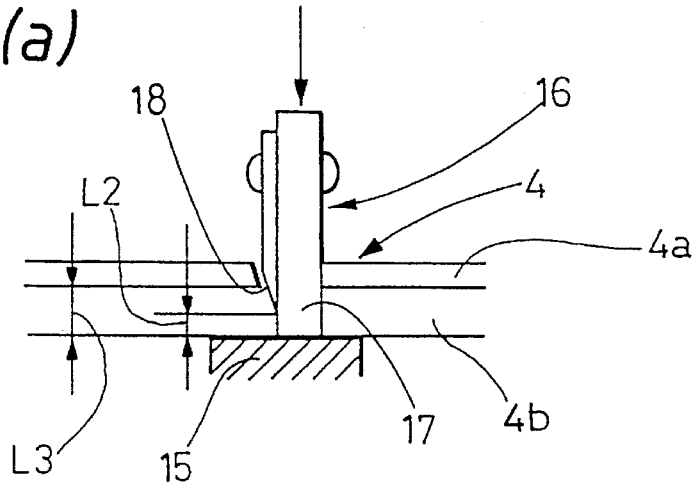
FIGS. 4(*al*) and 4(*b*) are explanatory diagrams for a a method of cutting a laminated tape with the half-cut mechanism.
Figure 4B:
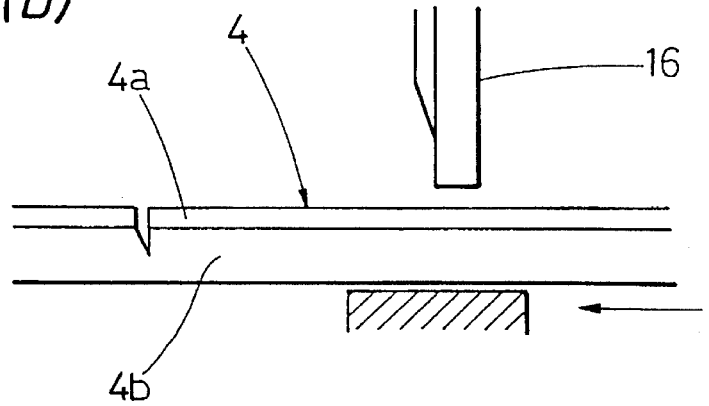

On the other hand, the half-cut mechanism b, as shown in FIG. 2, comprises: a tape receiving stand 15 formed at the end of a guide board 30; and a cutter 16 for cutting the laminated tape set on the tape receiving stand 15. The guide board 30 is set perpendicular to the direction in which the laminated tape is run out of the tape printer body. The guide board 30 has a through-hole, namely, a passing hole 15*a* adjacent to the tape receiving surface of the tape receiving stand 15 through which the laminated tape 4 posses. The tape receiving stand 15 receives the laminated tape 4 with the separate paper 4*b* on its surface. The cutter 16, as shown in FIG. 3, includes a base plate 19 having a pair of guide legs 17 at both ends, and a cutting edge 18 set between those guide legs 17. The cutter 16 is slidably arranged on the guide board 30 while the sliding movement of the cutter 16 is guided by a guide plate mounted on the guide board. In addition, the cutter 16 is biased by a coil spring 14*b* in such a manner that the cutter is brought into contact with a cutter drive cam 22 to be explained later. As the cutter 16 is slid on the guide board 30, the guide legs 17 are abutted against the above-described tape receiving stand 15, and the cutting edge 18 cuts the laminated tape 4 on the tape receiving stand 15 as shown in FIG. 4(*a*). The length L1 of the cutting edge 18 is larger than the width of the laminated tape 4, and the distance L2 between the cutting edge 18 and the ends of the guide legs 17 is smaller than the thickness L3 of the separate paper 4*b* of the laminated tape 4.

Figure 5:
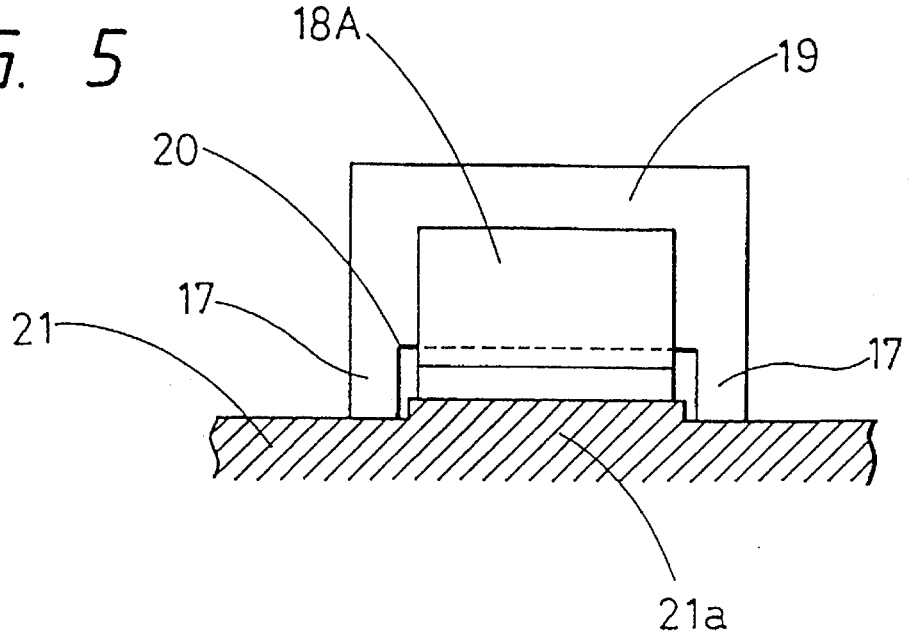
FIG. 5 is an explanatory diagram for the positional adjustment of a cutting edge in the cutter.

As was described above, the cutter 16 comprises the base plate 19 with the guide legs 17 and the cutting edge 18. However, it is considerably difficult to form the base plate 19 and the cutting edge 18 as one unit, because the distance L2 between the cutting edge 18 and the guide legs 17 must be extremely high in accuracy. Hence, it is preferable that the cutter 16 is formed by fixedly securing the cutting edge 18 to the base plate 19 with the guide legs 17 as shown in FIG. 3. In this case, it is preferable to use a jig 21 having a protrusion 21*a* as shown in FIG. 5. That is, the base plate 19 having the guide legs 17 is set on the jig 21, and the cutting edge 18 is set on the protrusion 21*a* of the jig 21. Under this condition, the cutting edge 18 is temporarily stuck on the base plate 19 with an adhesive agent or the like, and the cutting edge 18 is fixedly secured to the base plate 19, for instance, by caulking or by spot welding. The height of the protrusion 21*a* of the jig 21 is smaller than the thickness of the separate paper 4*b*. Thus, a cutter 16 high in dimensional accuracy can be easily formed.

As shown in FIG. 2, the Gutter drive cam 22 is provided at the other end of the cutter 16. The cutter drive cam 22 is coupled to a drive mechanism which comprises an electric motor 23 and a drive gear train 24.

The laminated tape 4, on which characters, figures, etc. have been printed by the printing section 1, is run out of the tape releasing section 2 by the platen 11. After the printed portion of the laminated tape 4 has passed through the full-cut mechanism a of the cutting section 3, the movement of the laminated tape 4 is suspended. Under this condition, the movable edge 13 is operated, to cut the laminated tape 4.

The laminated tape 4 thus cut is passed through the passing hole 15*a*. When the printed portion of the laminated tape 4 has passed through the passing hole 15*a*, the drive mechanism of the half-cut mechanism b is operated. As a result, the drive cam 22 is turned, so that the cutter 16 is slid on the guide board 14, whereby as shown in FIGS. 4(*a*) 4(*b*) the guide legs 17 abut against the tape receiving stand 15 while the cutting edge 18 cuts the laminated tape 4. In this operation, a gap smaller than the thickness of the separate paper 4*b* of the laminated tape 4 is formed between the cutting edge 18 and the tape receiving stand 15 because the distance L2 between the cutting edge 18 and the guide legs 17 is smaller than the thickness of the separate paper 4*b* of the laminated tape 4. Hence, although the printing tape 4*a* of the laminated tape 4 is completely cut by the cutting edge 18, at least a part of the separate paper 4*b* remains as it is, not being cut depending on the distance L2; that is, the laminated tape 4 is cut halfway. In the above-described cutting operation, the guide legs 17 abut against the tape receiving stand 15, but the cutting edge 18 not.

After the laminated tape 4 has been cut, the printing tape 4*a* can be stuck on any object as desired. When the laminated tape 4 is folded along the line where it has been cut halfway, both end portions of the printing tape 4*a* are raised as shown in FIG. 6. Hence, the printing tape 4*a* can be peeled easily off the separate paper 4*b*.

When the laminated tape 4 is cut with the full-cut mechanism a, the cut end is the top end of the laminated tape remaining in the tape printer body for the next printing operation. The laminated tape 4 remaining in the tape printer body will have a useless waste portion which extends from the top end to the printer head 5. As was described before, the laminated tape 4 is fed out from the tape printer body while characters, figures, etc. are printed therein it. In this case, heretofore the useless waste portion of the laminated tape 4 is cut off with the cutting section 3 before the feeding of the laminated tape. On the other hand, in present invention, the useless waste portion 25 is cut off with the half-cut mechanism as shown in FIG. 6. This is considerably advantageous because the printing tape 4*a* can be peeled off along the cut 26 which is formed when the useless waste portion 25 is cut off.

Figure 7:
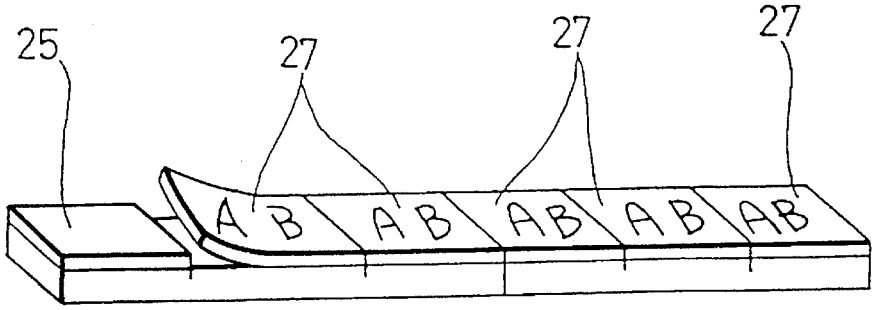
FIG. 7 is a perspective view showing another example of the method of cutting the laminated tape with the half-cut mechanism.

By operating the half-cut mechanism intermittently, a series of printing tapes 27, as shown in FIG. 7, can be obtained which can be peeled off with ease.

In the tape printer of the invention, the laminated tape is run out of the tape releasing section while characters, figures, are being printed thereon, and the half-cut mechanism for cutting only the printing tape of the laminated tape is provided at the tape releasing section. The half-cut mechanism is operated immediately before or after the portion where characters, figures, etc. have been printed comes to the half-cut mechanism. Therefore, at the portion immediately before or after the printed portion, the printing tape is cut, but the separate paper is not. The printing tape can be stuck on a desired object: The portion of the laminated tape is bent which has been cut halfway by the half-cut mechanism. As a result, both end portions of the printing tape which have been cut are raised from the separate paper, and therefore the printing tape can be readily peeled off the separate paper beginning with both end portions.

As was described before, the cutter of the half-cut mechanism is made up of the pair of guide legs which abut against the tape receiving stand, and the cutting edge. Hence, during the cutting operation, only the guide legs abut against the tape receiving stand, and the cutting edge will never abut against the tape receiving stand, and therefore the cutting edge is increased in service life.

Furthermore, the cutter is formed by fixedly securing the cutting edge member to the base plate having the guide legs.

That is, a cutter high in dimensional accuracy can be formed with ease.

The top end portion of the laminated tape always includes a useless waste portion; however, in the invention, the half-cut mechanism is operated to cut it, so that the peeling off and cutting of the printing tape are carried out along the cut which is formed when the useless waste portion is cut. In addition, by operating the half-cut mechanism intermittently, a series of printing tapes can be obtained which can be peeled off with ease. Thus, the tape printer according to the invention should be highly appreciated in practical use.

While there has been described in connection with the preferred embodiment of this invention, it will be obvious to those skilled in the art that various changes and modifications may be made therein without departing from the invention. Hence, all modifications and equivalent arrangements are intended to be covered by the appended claims.

What is claimed is:

1. A tape printer for printing on a laminated tape formed of a printing tape and a separate paper, said tape printer comprising:

a printer head disposed in a printing section of said tape printer for printing characters on said printing tape;

a half-cut means for cutting only said printing tape of said laminated tape; and a tape moving means for moving said laminated tape from said printing section to said half-cut means, wherein said half-cut means includes:

a tape receiving stand having a surface on which said laminated tape is moved; and a cutter member comprising:

a base plate having a pair of guide legs disposed substantially next to each other in a tape width direction so that said laminated tape is disposed therebetween, a cutter blade secured on said base plate, and a base plate moving means for moving said base plate and said cutter blade in such a manner that said guide legs directly abut against the surface of said tape receiving stand and said cutter blade cuts only said printing tape on the surface of said tape receiving stand.

2. A tape printer according to claim 1, in which said cutter member further comprises:

a guiding means for guiding the movement of said base plate relative to said tape receiving stand.

3. A tape printer according to claim 1, further comprising:

a laminated tape cutting means for cutting both said printing tape and said separate paper simultaneously, said laminated tape cutting means being operable individually from said half-cut means.

4. A tape printer according to claim 1, in which said base plate moving means comprises:

a cutter drive cam provided at an end of said base plate so as to be brought in contact with said end; and a drive mechanism for rotating said cutter drive cam.

5. A tape printer for printing on a laminated tape formed of a printing tape and a separate paper, said tape printer comprising:

a printer head disposed in a printing section of said tape printer for printing characters on said printing tape;

a half-cut means for cutting only said printing tape of said laminated tape; and a tape moving means for moving said laminated tape from said printing section to said half-cut means, wherein said half-cut means comprises:

a tape receiving stand for receiving said laminated tape; and a cutter for cutting said laminated tape on said tape receiving stand, wherein said cutter comprises:

a pair of guide legs which directly abut against said tape receiving stand during cutting, and which are disposed substantially next to each other in a tape width direction so that said laminated tape is disposed therebetween, and a cutting edge formed between said pair of guide legs, with the distance between said cutting edge and ends of said guide legs being smaller than the thickness of said separate paper.

6. A tape printer as claimed in claim 1, in which said cutter is made up of a base plate having said pair of guide legs, and a cutting edge member fixedly secured to said base plate.

* * * * *